US008647128B2

(12) United States Patent
Sykes et al.

(10) Patent No.: US 8,647,128 B2
(45) Date of Patent: Feb. 11, 2014

(54) COAXIAL CONNECTOR

(75) Inventors: Michael Timothy Sykes, Mechanicsburg, PA (US); Mattia Scheggia, Como (IT); Keith Richard Foltz, Duncannon, PA (US); Michael J. Block, Carlisle, PA (US); Kevin E. Weidner, Hummelstown, PA (US); Jeffrey K. Orner, Boiling Springs, PA (US); Tim R. Chevalier, Cleona, PA (US)

(73) Assignees: Tyco Electronics Corporation, Berwyn, PA (US); Tyco Electronics Logistics AG, Steinach (CH)

( * ) Notice: Subject to any disclaimer, the term of this patent is extended or adjusted under 35 U.S.C. 154(b) by 28 days.

(21) Appl. No.: 13/330,978

(22) Filed: Dec. 20, 2011

(65) Prior Publication Data

US 2013/0157504 A1 Jun. 20, 2013

(51) Int. Cl.
*H01R 9/05* (2006.01)

(52) U.S. Cl.
USPC ..... 439/63; 439/578

(58) Field of Classification Search
USPC ..... 439/63, 581, 582, 578, 620.09, 855, 439/620.12, 854
See application file for complete search history.

(56) References Cited

U.S. PATENT DOCUMENTS

| | | | | |
|---|---|---|---|---|
| 4,412,717 | A * | 11/1983 | Monroe | 439/582 |
| 6,948,977 | B1 * | 9/2005 | Behrent | 439/581 |
| 7,118,382 | B2 * | 10/2006 | Kerekes et al. | 439/63 |
| 7,896,655 | B1 * | 3/2011 | Blasick et al. | 439/63 |
| 2009/0137133 | A1 * | 5/2009 | Gou | 439/63 |
| 2011/0244720 | A1 * | 10/2011 | Peng | 439/578 |

* cited by examiner

*Primary Examiner* — Neil Abrams
*Assistant Examiner* — Travis Chambers

(57) ABSTRACT

A coaxial connector includes a center contact and a board contact coupled to the center contact that is terminated to a circuit board. An outer contact has a cavity that receives the center contact and board contact. The outer contact has a separable interface end mated to a mating connector and a terminating end mounted to the circuit board. A circuit board mount is coupled to the terminating end and electrically connects the outer contact to the circuit board. A dielectric insert is received in the cavity and includes a bore that receives and holds either the center contact or the board contact. The dielectric insert has structural features extending axially along an exterior of the dielectric insert with air gaps being defined between the structural features. The structural features engage the outer contact to secure the dielectric insert in the cavity.

20 Claims, 8 Drawing Sheets

COAXIAL CONNECTOR

CROSS REFERENCE TO RELATED APPLICATIONS

This application relates to U.S. patent application having Ser. No. 13/330,874 and titled COAXIAL CONNECTOR filed on the same day, the subject matter of which is herein incorporated by reference in its entirety.

BACKGROUND OF THE INVENTION

The subject matter herein relates generally to coaxial connectors.

A typical coaxial connector has a metal outer shell, an inner dielectric insert, and a center contact to carry the signal which is secured within the inner dielectric insert. Coaxial connectors may be either plug connectors or jack connectors of either standard or reverse polarity configurations. Coaxial connectors may be either terminated to cable or terminated to a printed circuit board (PCB). For cable-mounted applications, the outer metal shell is crimped or soldered to the outer metal braid or solid metal jacket of the coaxial cable to provide an electrical connection between the shielding of the cable and the connector, while the center contact is crimped to the central conductor of the coaxial cable to provide connection for the signal pathway. For board-mounted applications, the outer metal shell is mechanically and electrically connected to a ground conductor of the PCB, while the center contact is mechanically and electrically connected to a signal conductor of the PCB.

Typical coaxial connectors are not without disadvantages. For instance, some coaxial connectors are right angle coaxial connectors where mating and terminating ends of the coaxial connectors are oriented generally perpendicular to one another. Such connectors are complex and costly to design and tool. It is difficult to maintain the impedance of such connectors between the mating and terminating ends as the signal path turns 90° within the connector. Additionally, typical coaxial connectors on the market are not platform designs, and do not enable customization or automated manufacturing. For example, the plug connectors are manufactured from multiple pieces or components specific to the plug connector design and the jack connectors are manufactured from multiple pieces or components specific to the jack connector design. Additionally, the cable-mounted connectors are manufactured from multiple pieces or components specific to the cable mounting design and the board-mounted connectors are manufactured from multiple pieces or components specific to the board mounting design. Moreover, the coaxial connectors are typically assembled by hand, which is time consuming. The pieces and components of the coaxial connectors are typically screw machined.

A need remains for a coaxial connector platform that allows for product design extensions, automated manufacturing and/or low cost.

BRIEF DESCRIPTION OF THE INVENTION

In one embodiment, a coaxial connector is provided including a center contact configured to be mated with a center contact of another coaxial connector and a board contact coupled to the center contact that is configured to be terminated to a circuit board. An outer contact has a cavity that receives the center contact and board contact, which are electrically connected to one another in the cavity. The outer contact has a separable interface end configured to be mated to a mating connector and a terminating end configured to be mounted to the circuit board. A circuit board mount is coupled to the terminating end and is configured to electrically connect the outer contact to the circuit board. A dielectric insert is received in the cavity and includes a bore that receives and holds either the center contact or the board contact. The dielectric insert has structural features extending axially along an exterior of the dielectric insert with air gaps being defined between the structural features. The structural features engage the outer contact to secure the dielectric insert in the cavity.

In another embodiment, a coaxial connector is provided including a center contact configured to be mated with a center contact of another coaxial connector and a board contact coupled to the center contact that is configured to be terminated to a circuit board. A dielectric insert includes a bore that receives and holds at least one of the center contact and the board contact. An outer contact has a cavity that receives the center contact and board contact being electrically connected to one another in the cavity. The outer contact has a separable interface end configured to be mated to a mating connector and a terminating end. The outer contact has a barrel at the terminating end and a shroud surrounding the barrel with a groove disposed between the barrel and the shroud. The outer contact is interchangeably coupled to either a first circuit board mount or a second circuit board mount at the terminating end. The first and second circuit board mounts both include a cylindrical rim and mounting legs extending from the rim. The rims are selectively received in the groove. The mounting legs of the first circuit board mount configured to be through hole mounted to the circuit board and the mounting legs of the second circuit board mount configured to be surface mounted to the circuit board.

In a further embodiment, a coaxial connector is provided including a center contact configured to be mated with a center contact of another coaxial connector. The center contact has a mating end and a terminating end. The center contact has an open-sided barrel at the terminating end with two paddles opposing one another across a gap. A board contact is configured to be terminated to a circuit board. The board contact is received in the gap between the paddles with the paddles pressing against the board contact to make an electrical connection between the board contact and the center contact. An outer contact has a cavity. The center contact and board contact are disposed in the cavity and are electrically connected to one another in the cavity. The outer contact has a separable interface end configured to be mated to a mating connector and a terminating end configured to be mounted to the circuit board.

DETAILED DESCRIPTION OF THE INVENTION

Figure 1:
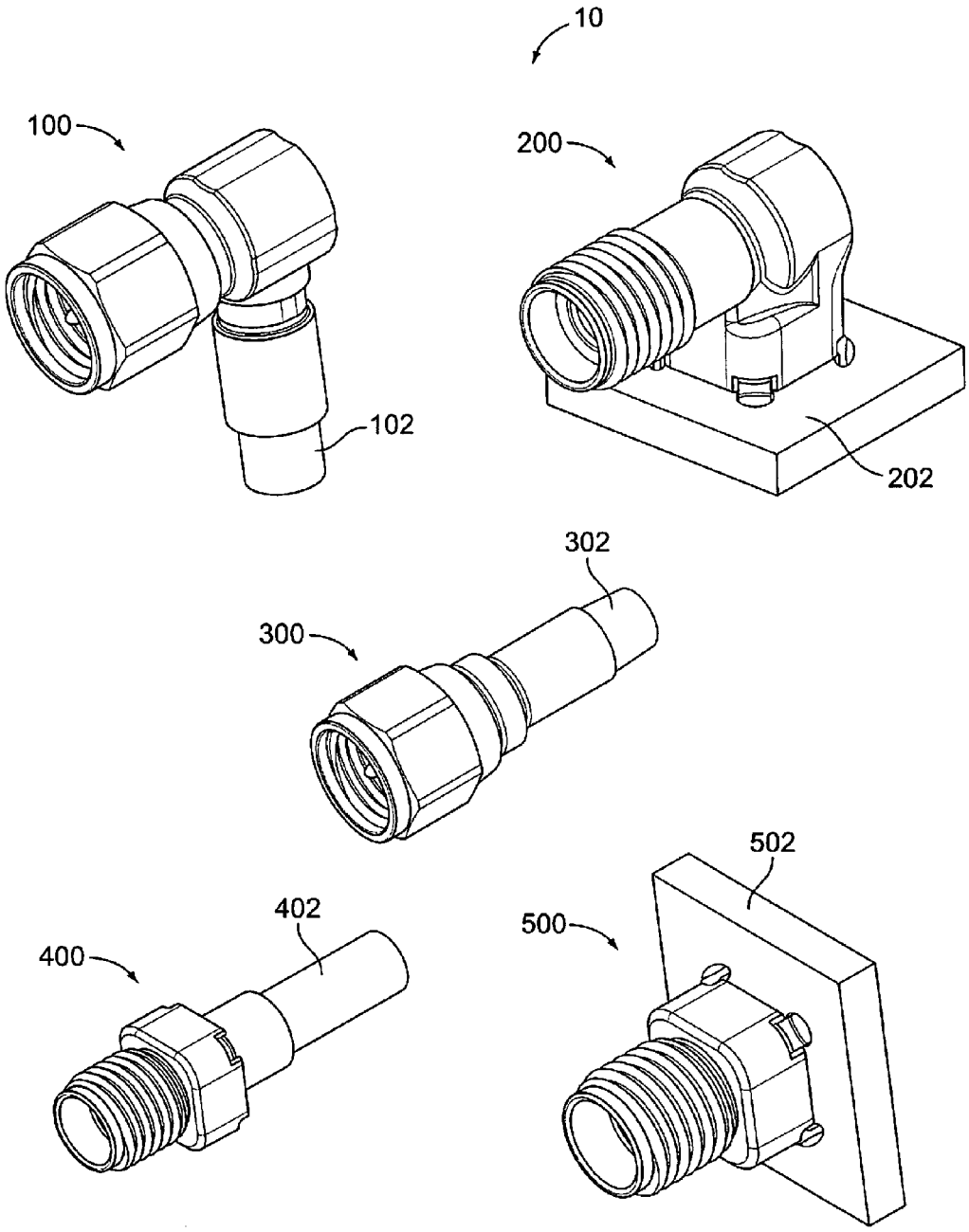
FIG. 1 illustrates a coaxial connector system formed in accordance with an exemplary embodiment.

FIG. 1 illustrates a coaxial connector system 10 formed in accordance with an exemplary embodiment. The coaxial connector system 10 may use different types of plug and jack coaxial connectors, such as different combinations of cable mounted connectors and board mounted connectors and/or different combinations of in-line and right angle connectors. The connections may be cable-to-cable, board-to-board or cable-to-board connections. Exemplary embodiments of versions of such connectors are illustrated in FIG. 1. FIG. 1 illustrates a right angle, cable-mounted plug connector 100, a right angle, board-mounted jack connector 200, an in-line, cable-mounted plug connector 300, an in-line, cable-mounted jack connector 400, and an in-line, board-mounted jack connector 500. The plug connectors are matable with the jack connectors. In an exemplary embodiment, the different versions of the coaxial connectors use interchangeable components across the product family to decrease the overall cost of the product family, such as tooling costs, stocking costs, and the like.

The plug connector 100 is terminated to a coaxial cable 102. The jack connector 200 is terminated to a circuit board 202. The plug connector 300 is terminated to a coaxial cable 302. The jack connector 400 is terminated to a coaxial cable 402. The jack connector 500 is terminated to a circuit board 502. The plug connectors 100, 300 are configured to be threadably coupled to one of the jack connectors 200, 400, 500 using internal threads on the plug connectors 100, 300 and external threads on the jack connectors 200, 400, 500. Alternative coupling means may be used in alternative embodiments.

Figure 2:
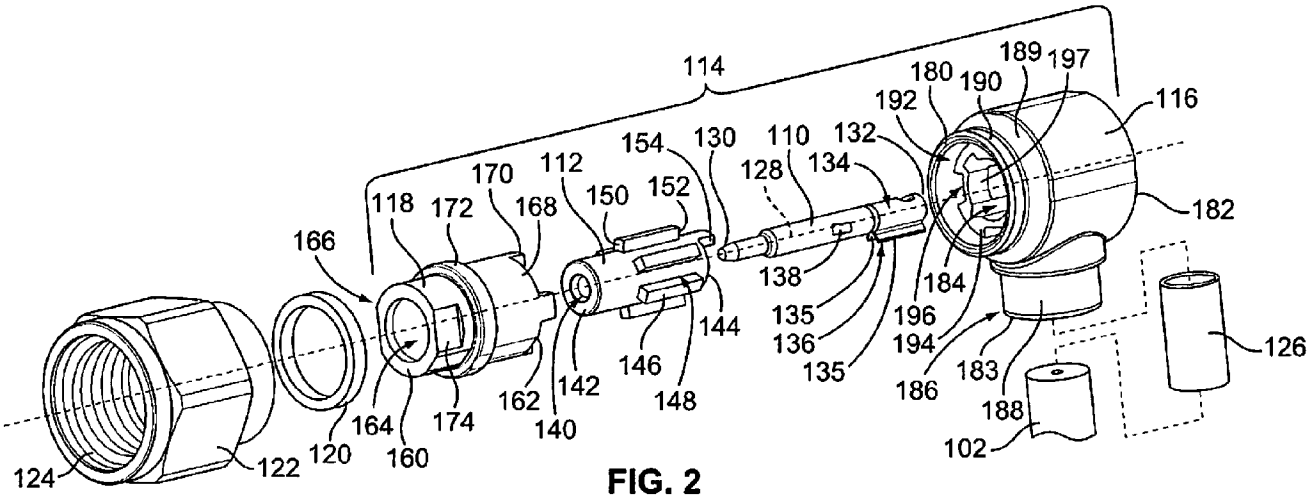
FIG. 2 is a front exploded views of a plug connector of the coaxial connector system in accordance with an exemplary embodiment.
Figure 3:
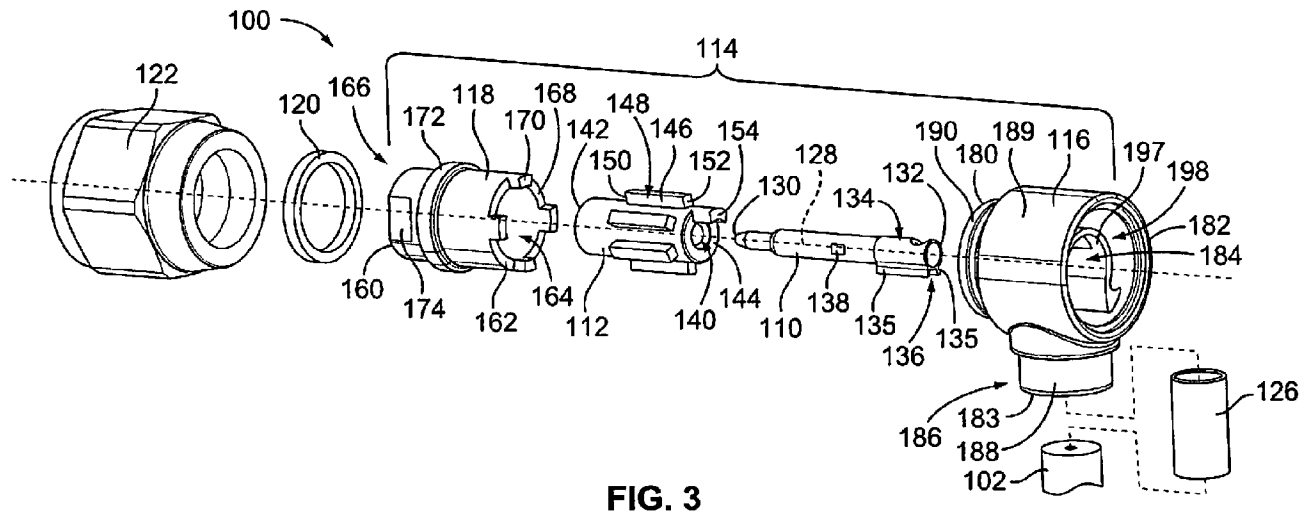
FIG. 3 is a rear exploded views of the plug connector in accordance with an exemplary embodiment.

FIGS. 2 and 3 are front and rear exploded views of the plug connector 100. The plug connector 100 includes a center contact 110, a front dielectric insert 112 that holds the center contact 110 and an outer contact 114 that receives the dielectric insert 112 and the center contact 110. The center contact 110 is configured to be terminated to a center conductor (not shown) of the coaxial cable 102 (shown in FIG. 1), either directly through direct engagement between the center contact 110 and the center conductor or indirectly through a separate pin contact terminated to the end of the center conductor that is then directly connected to the center contact 110. The outer contact 114 is configured to be electrically connected to an outer conductor or cable shield (not shown) of the coaxial cable 102, such as by crimping or soldering to the cable shield.

In an exemplary embodiment, the outer contact 114 is a multi-piece body formed from a rear housing 116 and a front housing 118. In the illustrated embodiment, the front housing 118 defines a plug housing and may be referred to hereinafter as the plug housing 118. The rear housing 116 may be a single-piece housing or may be a multi-piece housing. In an exemplary embodiment, the product family may include multiple different versions of the rear housings 116 that define a set of rear housings 116 adapted to be connected to different sized cables. Each of the rear housings 116 may be coupled to the same front housing 118, thus reducing the total number of components in the product family.

The plug connector 100 includes a gasket 120 coupled to the front housing 118 to seal against the jack connector 200 (shown in FIG. 1) when mated thereto. The plug connector 100 includes a coupling nut 122 that is configured to be rotatably coupled to the front housing 118. The coupling nut 122 has internal threads 124 for securing the plug connector 100 to the jack connector 200.

The plug connector 100 includes a crimp barrel 126 coupled to the rear housing 116. The crimp barrel 126 is used to crimp the plug connector 100 to the coaxial cable 102. The crimp barrel 126 is used to mechanically and electrically connect the plug connector 100 to the coaxial cable 102.

The center contact 110 extends along a contact axis 128 of the plug connector 100 between a separable interface end or mating end 130 and a non-separable terminating end 132. The mating end 130 is configured to be mated with a corresponding contact of the jack connector 200 when the plug connector 100 is coupled thereto. Optionally, the center contact 110 may be selectively plated at the mating end 130 to enhance the performance and/or conductivity of the separable interface. In the illustrated embodiment, the mating end 130 defines a pin, however the center contact 110 may have a different mating interface in an alternative embodiment, such as a socket, such as to define a reverse polarity connector. In an exemplary embodiment, the center contact 110 is a stamped and formed contact. Stamped and formed contacts may be less expensive to manufacture than machined contacts. Stamped and formed contacts may have more complex shapes and features than machined contacts.

The terminating end 132 is configured to be terminated to a center conductor of the coaxial cable 102. In an exemplary embodiment, the center contact 110 has an open sided barrel 134 at the terminating end 132. The barrel 134 is configured to receive the center conductor of the coaxial cable 102 therein. Alternatively, the barrel 134 may receive another contact, such as a pin contact, that is terminated to the end of the conductor. In an exemplary embodiment, the barrel 134 includes a pair of paddles 135 opposing one another and separated by a gap 136. The center conductor (or the pin contact) is received in the gap 136 between the paddles 135. The paddles 135 press against the conductor (or the pin contact) to create an electrical connection therewith. The conductor (or the pin contact) may be terminated using a poke-in type of connection, which is advantageous for automation assembly processes. Optionally, the conductor may be soldered in the barrel 134. In other alternative embodiments, center contact 110 may be terminated to the center conductor (or the pin contact) by other processes or methods, such as crimping, indenting, lancing, active beam termination, insulation displacement connection, and the like. By allowing the center contact 110 to be terminated to the center conductor in more than one manner, the same center contact 110 can be used for different applications and by different customers who prefer termination by either crimping or soldering. As such, the product family does not need to include different types of center contacts for different types of termination, thereby reducing the overall number parts for the product family and reducing the overall cost of the platform.

The paddles 135 and/or the gap 136 define an orientation feature of the center contact 110 that allows the center contact 110 to be held at a particular orientation with respect to a machine used to assemble the plug connector 100. The paddles 135 and/or the gap 136 allow for automation of the assembly process of the plug connector 100 by allowing the center contact 110 to be held by a machine and inserted into the dielectric insert 112.

The center contact 110 includes locking tabs 138 extending therefrom. The locking tabs 138 are deflectable. The locking tabs 138 are used to secure the center contact 110 in the dielectric insert 112.

The front dielectric insert 112 is manufactured from a dielectric material, such as a plastic material. The dielectric material may be a composite material. The dielectric insert 112 has a bore 140 extending therethrough that receives and holds the center contact 110. The dielectric insert 112 extends between a front 142 and a rear 144. The bore 140 extends entirely through the dielectric insert 112 between the front 142 and the rear 144. The bore 140 extends axially along the contact axis 128 of the plug connector 100.

The dielectric insert 112 is generally tubular in shape and includes a plurality of structural features 146, such as wings or tabs, extending radially outward from an exterior of the tubular dielectric insert 112. In an exemplary embodiment, the structural features 146 extend axially along an exterior of the dielectric insert 112. Having the structural features 146 extend axially allows the dielectric insert 112 to be molded rather screw machined, which may be a less expensive manufacturing of the dielectric insert 112. Air gaps 148 are defined between the structural features 146 and introduce air (another type of dielectric) in the isolation area around the center contact 110. In the illustrated embodiment, the structural features 146 extend only partially along the dielectric insert 112. Optionally, the structural features 146 may extend along approximately half the axial length of the dielectric insert 112. The structural features 146 may extend any axial distance along the dielectric insert 112 in alternative embodiments. In the illustrated embodiment, the structural features 146 are located proximate to the rear 144, however the structural features 146 may be located at any axial position along the dielectric insert 112.

The structural features 146 are used to secure the front dielectric insert 112 within the outer contact 114. In an exemplary embodiment, the dielectric insert 112 is received within the front housing 118 and the structural features 146 engage the front housing 118 to secure the dielectric insert 112 in the front housing 118. The structural features 146 may engage the outer contact 114 and hold the dielectric insert 112 by an interference fit therein. In an exemplary embodiment, the structural features 146 are tapered from a front 150 to a rear 152 of the structural features 146 to increase the diameter of the dielectric insert 112 at the rear 144. As the dielectric insert 112 is loaded into the front housing 118, the structural features 146 begin to engage the front housing 118 and create a tighter fit between the dielectric insert 112 and the front housing 118 as the dielectric insert 112 is further loaded into the front housing 118.

In an exemplary embodiment, the size and shape of the structural features 146 are selected to provide a desired dielectric constant of the dielectric between the center contact 110 and the outer contact 114. When the center contact 110 and dielectric insert 112 are loaded into the outer contact 114, the center contact 110 is electrically isolated from the outer contact 114 by the material of the dielectric insert 112 and by air. The air and the dielectric insert 112 constitute the dielectric between the center contact 110 and the outer contact 114. The dielectric constant is affected by the amount of material of the dielectric insert 112 as well as the amount of air. The material of the dielectric insert 112 has a dielectric constant that is greater than the dielectric constant of air. By selecting the size and shape of the dielectric insert 112, including the structural features 146, the impedance of the plug connector 100 may be tuned, such as to achieve an impedance of 50 Ohms or another target impedance. For example, a design having more plastic in the isolation area between the outer contact 114 and the center contact 110 (e.g., a thicker tube, wider structural features 146, more structural feature 146, longer structural features 146, and the like) may decrease the impedance, whereas providing more air may increase the impedance.

In an exemplary embodiment, the dielectric insert 112 includes an extension 154 extending rearward from the dielectric insert 112. The extension 154 may be located generally along the top of the center contact 110 when loaded into the dielectric insert 112. The extension 154 may be located in other locations in alternative embodiments. More than one extension 154 may be used in alternative embodiments. The extension 154 may extend into the rear housing 116 when the plug connector is assembled. The extension 154 may be positioned between the center contact 110 and the rear housing 116 to position a predetermined amount of dielectric material between the center contact 110 and the rear housing 116, such as to control the impedance of the signal path along the extension 154.

The front housing 118 extends between a front 160 and a rear 162. The front housing 118 has a cavity 164 extending between the front 160 and the rear 162. The cavity 164 receives the dielectric insert 112 and center contact 110. In an exemplary embodiment, the front 160 of the front housing 118 defines a separable interface end 166 of the outer contact 114. The rear 162 of the front housing 118 is configured to be coupled to the rear housing 116.

The front housing 118 includes a barrel 168 at the rear 162. A plurality of posts 170 extend rearward from the barrel 168. As described in further detail below, the posts 170 are configured to be staked to the rear housing 116 to secure the front housing 118 to the rear housing 116. For example, a special tool may be used to push down on the posts 170 to deform the posts 170. The tool has a special shape to deform the posts and to force portions of the posts over the end of the rear housing 116 thereby securing the front housing 118 to the rear housing 116. The front housing 118 may be coupled to the rear housing 116 by other means or processes in alternative embodiments.

The front housing 118 includes a flange 172 extending from an exterior of the front housing 118. The flange 172 extends circumferentially around the front housing 118. The flange 172 is positioned forward of the barrel 168. The flange 172 is used to secure the coupling nut 122 to the front housing 118.

The front housing 118 includes flat surfaces 174 on an exterior thereof. The flat surfaces 174 are configured to angularly orient the front housing 118 with respect to the rear housing 116 during coupling of the front housing 118 to the rear housing 116. For example, the posts 170 may be oriented at a particular angular orientation with respect to the rear housing 116 during assembly. The flat surfaces 174 may be engaged by a machine used to assemble the plug connector 100 to hold the angular position of the front housing 118 for loading the front housing 118 into the rear housing 116. Other features may be provided in alternative embodiments that allow the front housing 118 to be oriented with respect to the assembly machine for assembly of the plug connector 100.

The rear housing 116 is configured to be interchangeably coupled to the front housing 118 with other differently sized/shaped rear housings, such as to mate to differently sized cables. The rear housing 116 includes a front 180 and a rear 182. The rear housing 116 includes a bottom 183. The bottom is oriented generally perpendicular with respect to the front 180 and the rear 182. A cavity 184 extends through the rear housing 116. The cavity 184 makes a 90° bend within the rear housing 116. The cavity 184 is open at the front 180, the rear 182 and the bottom 183. The bottom 183 of the rear housing 116 defines a terminating end 186 of the outer contact 114. When the rear housing 116 is coupled to the front housing 118, the terminating end 186 is oriented generally perpendicular with respect to the separable interface end 166. The plug connector 100 defines a right angle or 90° connector. The cable 102 extends generally at a right angle or 90° with respect to the center contact 110. The signal path through the plug connector 100 is changed along the right angle path.

The rear housing 116 includes a tube 188 at the bottom 183. The tube 188 is configured to interface with the cable 102. For example, the tube 188 may receive the cable 102. The tube 188 may be crimped or otherwise secured to the cable 102. The rear housing 116 includes an interface body 189 at the front 180. The interface body 189 is configured to interface with the front housing 118. In the illustrated embodiment, the tube 188 and the interface body 189 are integrally formed. The tube 188 and the interface body 189 are a single-piece body. In alternative embodiments, the tube 188 and the interface body 189 may be separate pieces that are coupled together. Different rear housings 116 may be defined as having different sized tubes 188 (e.g. different lengths, different diameters, different shapes, and the like). In the single-piece version, the entire rear housing 116 may be removed from the front housing 118 and replaced with a different rear housing 116 having a different sized tube 188. In the multi-piece version, the same interface body 189 is utilized to couple to the front housing 118, but differently sized tubes 188 are interchangeably coupled to the bottom of the interface body 189.

The rear housing 116 includes a rim 190 proximate to the front 180. The interface body 189 forms the rim 190. The rim 190 defines a chamber 192 that receives the front housing 118. The rim 190 and chamber 192 define a housing interface 194 at the front 180 of the rear housing 116. The front housing 118 is coupled to the housing interface 194.

In an exemplary embodiment, the rear housing 116 includes a plurality of openings 196 at a rear or bottom of the chamber 192. When the front housing 118 is coupled to the rear housing 116, the barrel 168 of the front housing 118 is received in the chamber 192 and the posts 170 of the front housing 118 extend through corresponding openings 196 in the rear housing 116. The posts 170 extend entirely through the openings 196 and may be staked from behind the rim 190 to secure the front housing 118 to the rear housing 116. For example, the ends of the posts 170 are located in the cavity 184 and are staked from inside the cavity 184. A tool or machine may be inserted into the cavity 184 through the rear 182 to stake the posts 170 to the rear housing 116. Alternatively, the ends of the posts 170 may be accessible from the exterior of the rear housing 116.

The rear housing 116 includes an inner shield 197 in the cavity 184 and/or defining part of the cavity 184. The inner shield 197 may be integrally formed with the rear housing 116, such as during a common molding or forming process. Alternatively, the inner shield 197 may be separate from the rear housing 116 and loaded into the rear housing 116. The inner shield 197 may be shaped complementary to the shape of the barrel 134 of the center contact 110, with the inner shield 197 being spaced apart from the barrel 134 by a predetermined distance selected to control the impedance of the signal path through the plug connector 100. The size and shape of the inner shield 197 may be selected to tune or control the impedance, such as to achieve a target impedance along such portion of the rear housing 116. For example, the size and shape of the inner shield 197 may be selected to allow a certain volume of air to be positioned between the inner shield 197 and the center contact 110.

The interior of the inner shield 197 defines a portion of the cavity 184 and is sized to ensure that the barrel 134 does not touch (e.g. electrically short) the center contact 110. In an exemplary embodiment, a gap 198 is defined between the inner shield 197 and the interior surface of the rear housing 116. The gap 198 provides a space for a staking tool to engage the posts 170 to stake the front housing 118 to the rear housing 116.

Figure 4:
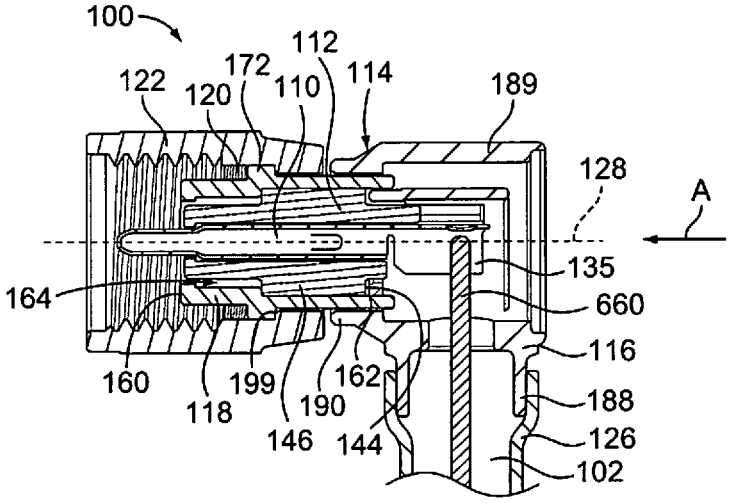
FIG. 4 is a cross-sectional view of the plug connector in accordance with an exemplary embodiment.

FIG. 4 is a cross-sectional view of the plug connector 100 showing the center contact 110 loaded into the dielectric insert 112 and outer contact 114. During assembly, the gasket 120 is loaded onto the front 160 of the front housing 118. The gasket 120 is seated against the flange 172. The coupling nut 122 is loaded onto the rear 162 of the front housing 118. The coupling nut 122 extends forward of the front 160 of the front housing 118. The coupling nut 122 defines a chamber that receives a portion of the jack connector 200 (shown in FIG. 1). The coupling nut 122 includes a lip 199 that engages the flange 172 to stop forward loading of the coupling nut 122 onto the front housing 118. The lip 199 is captured between the flange 172 and the rim 190 of the rear housing 116 to axially position the coupling nut 122 with respect to the front housing 118. The coupling nut 122 is rotatable with respect to the front housing 118. The flange 172 limits forward movement of the coupling nut 122 and the rim 190 limits rearward movement of the coupling nut 122.

The dielectric insert 112 is inserted into the front housing 118 through the rear 162. The structural features 146 engage the front housing 118 to hold the dielectric insert 112 in the cavity 164 by an interference fit. In an exemplary embodiment, the rear 144 of the dielectric insert 112 is positioned forward of the rear 162 of the front housing 118. The front housing 118 is coupled to the rear housing 116 such that the rear 162 engages the wall defining the bottom of the chamber 192. The rear 162 of the front housing 118 is received in the chamber 192 (shown in FIG. 2). The rim 190 circumferentially surrounds the rear 162 of the front housing 118. The wall at the rear or bottom of the chamber 192 is positioned behind the dielectric insert 112 to ensure that the dielectric insert 112 remains in position in the front housing 118. The posts 170 (shown in FIG. 2) extend into the rear housing 116 and are staked inside the rear housing 116.

The center contact 110 is loaded along the contact axis 128 in a loading direction, shown by the arrow A. The center contact 110 may be loaded into the outer contact 114 at any stage of the assembly process. For example, the center contact 110 may be loaded into the dielectric insert 112 prior to the dielectric insert 112 being loaded into the front housing 118. Alternatively, the center contact 110 may be loaded into the dielectric insert 112 after the front housing 118 and rear housing 116 are coupled together.

In the illustrated embodiment, the rear housing 116 is a one-piece body with the tube 188 formed integral with the interface body 189. The cavity in the tube 188 is open to the cavity in the interface body 189 to allow the cable 102 to extend into the cavity in the interface body 189 for termination to the center contact 110. An exposed conductor 660 of the cable 102 is pressed into the center contact 110 between the paddles 135. The paddles 135 make electrical connection with the center contact 110. Optionally, the conductor 660 may be soldered to the center contact 110 to make an electrical and mechanical connection with the center contact 110. In an alternative embodiment, a pin contact may be terminated to the center conductor 660 and the pin contact may be inserted into the center contact 110 between the paddles 135 to make an electrical connection between the center conductor 660 and the center contact 110. The tube 188 is sized to snuggly fit the cable 102 therein. The crimp barrel 126 is used to mechanically and/or electrically connect the tube 188 to the cable 102. The crimp barrel 126 may provide strain relief.

Figure 5:
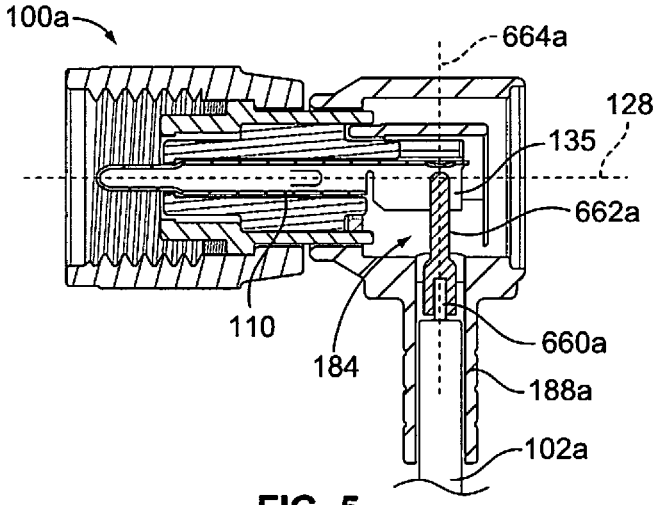
FIG. 5 illustrates a plug connector in accordance with an exemplary embodiment.
Figure 6:
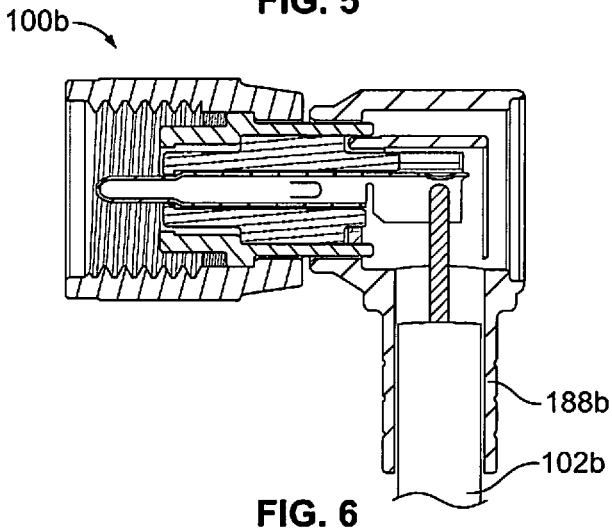
FIG. 6 illustrates a plug connector in accordance with an exemplary embodiment.

FIGS. 5 and 6 show alternative plug connectors 100*a* and 100*b* having different sized tubes 188*a*, 188*b*, respectively, which are sized differently than the tube 188 (shown in FIG. 4). The tubes 188*a*, 188*b* are used with differently sized cables 102*a*, 102*b*. FIG. 5 also illustrates a pin contact 662*a* terminated to an end of the conductor 660*a*. The pin contact 662*a* extends into the cavity 184 to engage the center contact 110. The pin contact 662*a* extends along a pin contact axis 664*a*, which may be oriented generally perpendicular to the contact axis 128. The paddles 135 make a mechanical and electrical connection to the pin contact 662*a*.

Figure 7:
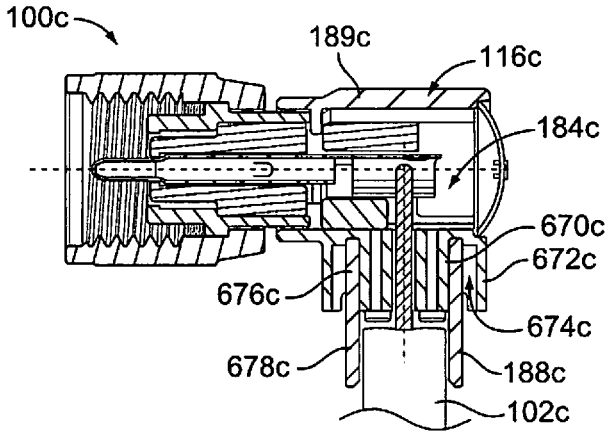
FIG. 7 illustrates a plug connector in accordance with an exemplary embodiment.
Figure 8:
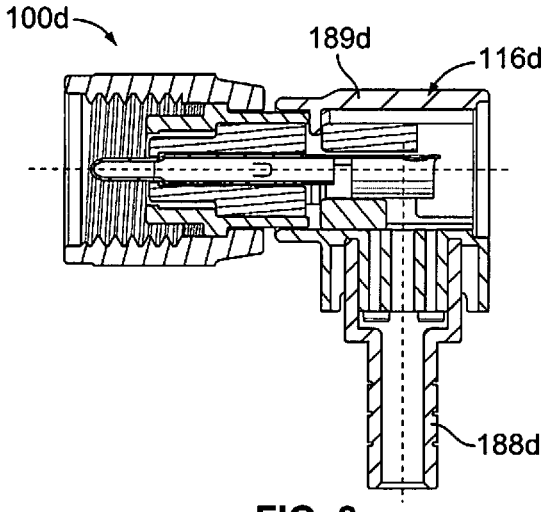
FIG. 8 illustrates a plug connector in accordance with an exemplary embodiment.
Figure 9:
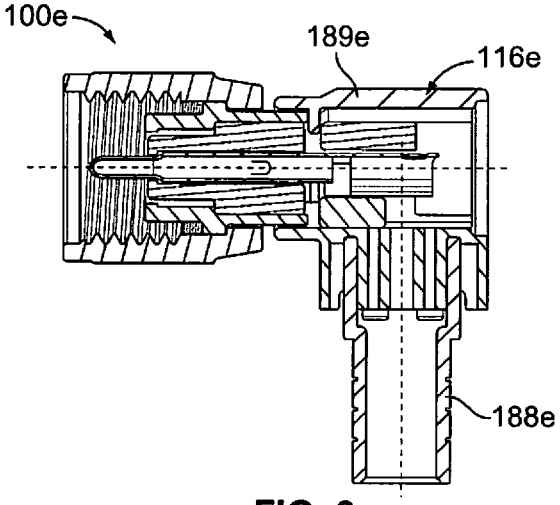
FIG. 9 illustrates a plug connector in accordance with an exemplary embodiment.

FIGS. 7, 8 and 9 show alternative plug connectors 100*c*, 100*d* and 100*e*, respectively. The plug connectors 100*c*, 100*d*, 100*e* have two-piece rear housings 116*c*, 116*d*, 116*e*. The tubes 188*c*, 188*d*, 188*e* are separate and discrete pieces from the interface bodies 189*c*, 189*d*, 189*e*. In an exemplary embodiment, the interface bodies 189*c*, 189*d*, 189*e* are identical to one another or are the same part, thus reducing the total number of different parts for the product family. The tubes 188*c*, 188*d*, 188*e* are all able to attach to the same interface body.

The features of the interface bodies 189*c*, 189*d*, 189*e* will be described with reference to the interface body 189*c*, however the other interface bodies 189*d*, 189*e* may include similar or identical features. The interface body 189*c*, at a bottom thereof, includes a barrel 670*c* circumferentially surrounding the cavity 184*c*. A shroud 672*c* peripherally surrounds the barrel 670*c*. The shroud 672*c* is generally box-shaped and defines an outer perimeter of the interface body 189*c* at the bottom. A circumferential groove 674*c* is defined between the barrel 670*c* and the shroud 672*c*.

The features of the tubes 188*c*, 188*d*, 188*e* will be described with reference to the tube 188*c*, however the other tubes 188*d*, 188*e* may include similar or identical features. The tube 188*c* includes a mounting block 676*c* and an extension 678*c*. The mounting block 676*c* is secured to the interface body 189*c*. In an exemplary embodiment, the mounting block 676*c* is received in the groove 674*c* and mechanically secured therein. For example, crush ribs may be provided on the barrel 670*c* or the tube 188*c*. The extension 678*c* extends downward from the mounting block 676*c* and the interface body 189*c* to receive the cable 102*c*.

Figure 10:
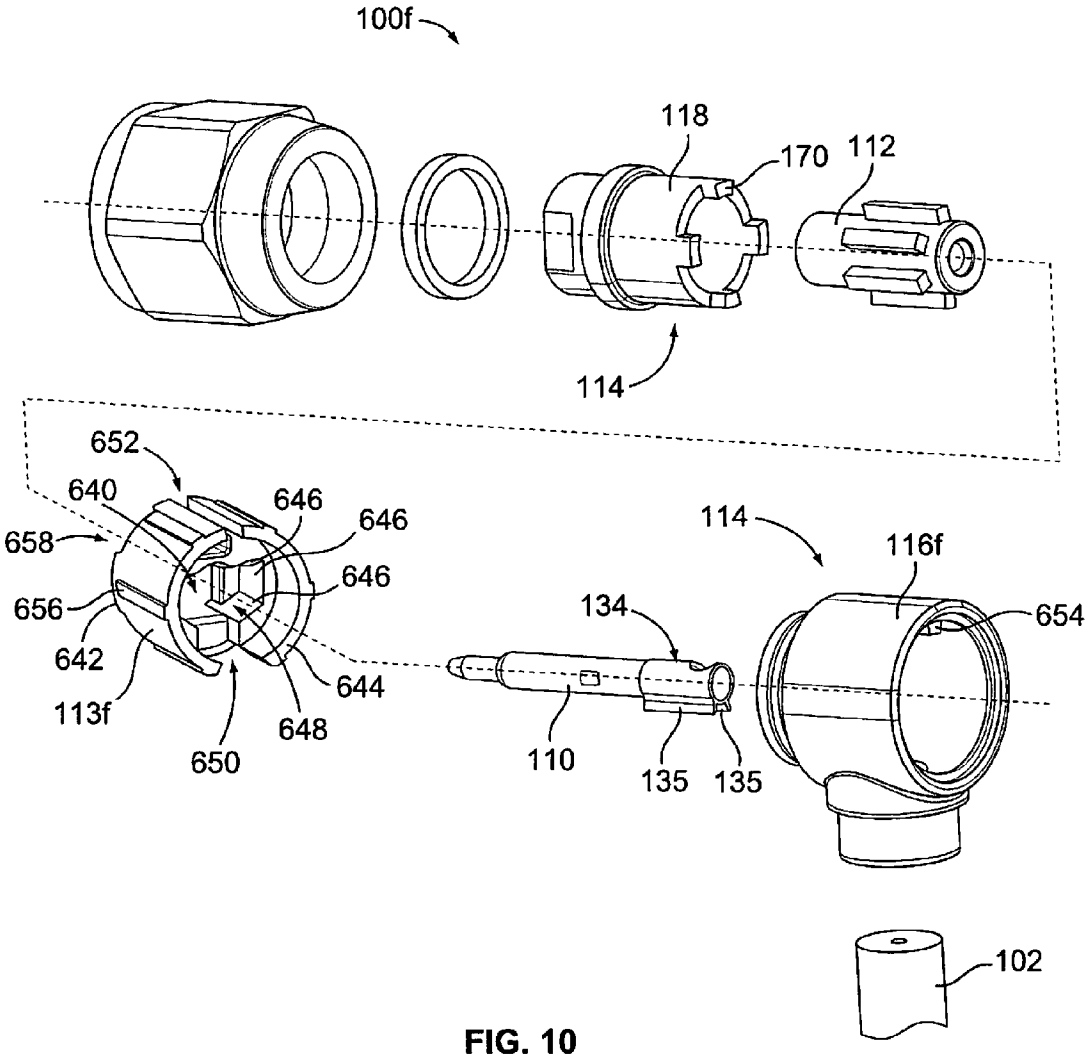
FIG. 10 illustrates a plug connector in accordance with an exemplary embodiment.

FIG. 10 is an exploded view of an alternative plug connector 100*f*. The plug connector 100*f* includes similar features as the plug connector 100 (shown in FIGS. 2 and 3), which will be identified with like reference numerals. However the plug connector 100*f* includes a rear dielectric insert 113*f* in addition to the center contact 110, front dielectric insert 112 (shaped slightly different to accommodate the rear dielectric insert 113) and outer contact 114. The outer contact 114 includes the front housing 118 and a rear housing 116*f*, similar to the rear housing 116 (shown in FIGS. 2 and 3), however the rear housing 116*f* does not include the inner shield 197 (shown in FIGS. 2 and 3).

The rear dielectric insert 113*f* is manufactured from a dielectric material, such as a plastic material. The dielectric material may be a composite material. The dielectric insert 113*f* has a bore 640 extending therethrough that receives and/or holds the center contact 110. The dielectric insert 113*f* extends between a front 642 and a rear 644. The bore 640 extends entirely through the dielectric insert 113*f* between the front 642 and the rear 644.

The dielectric insert 113*f* is generally tubular in shape and includes a plurality of structural features 646, such as walls or tabs, surrounding the bore 640. The dielectric insert 113*f* also includes air pockets 648 open to the bore 640. The structural features 646 define the air pockets 648. The air pockets 648 introduce air (another type of dielectric) in the isolation area around the center contact 110. The air pockets 648 are positioned in the vicinity of the paddles 135. The air pockets 648 provide a space for the paddles 135 to deflect or spread outward, such as when the conductor of the cable 102 (or the pin contact) is inserted into the center contact 110.

The dielectric insert 113*f* includes a radial opening 650 open to the bore 640. The radial opening 650 receives the conductor of the cable 102 (or the pin contact) therethrough during assembly such that the conductor (or pin contact) may be coupled to the center contact 110. In the illustrated embodiment, the radial opening 650 is provided at a bottom of the dielectric insert 113*f*.

The dielectric insert 113*f* includes a channel 652 extending along an exterior of the dielectric insert 113*f*. The channel 652 defines a keying or orientation feature of the dielectric insert 113*f*. A rib 654 of the outer contact 114 extends into the channel 652 to orient the dielectric insert 113*f* in the rear housing 116*f*. Other types of keying features may be used in alternative embodiments. The structural features 646, channel 652 and/or the radial opening 650 individually or together allow for automation of the assembly process of the plug connector 100*f* by allowing the dielectric insert 113*f* to be held by a machine and inserted into the rear housing 116*f*.

The dielectric insert 113*f* includes crush ribs 656 to secure the dielectric insert 113*f* in the rear housing 116*f*. Other securing features may be used in alternative embodiments. The dielectric insert 113*f* may include similar structural features and air gaps along the exterior thereof as the dielectric insert 112.

The dielectric insert 113*f* includes pockets 658 in the front 642. The pockets 658 receive the posts 170 when the plug connector 100*f* is assembled. The engagement between the posts 170 and the pockets 658 may be used to help align and/or resist rotation of the dielectric insert 113*f* in the rear housing 116*f* when assembled.

In an exemplary embodiment, the size and shape of the structural features 646 and corresponding air pockets 648 are selected to provide a desired dielectric constant of the dielectric between the center contact 110 and the outer contact 114. When the center contact 110 and dielectric insert 113*f* are loaded into the outer contact 114, the center contact 110 is electrically isolated from the outer contact 114 by the material of the dielectric insert 113*f* and by air. The air and the dielectric insert 113*f* constitute the dielectric between the center contact 110 and the outer contact 114. The dielectric constant is affected by the amount of material of the dielectric insert 113*f* as well as the amount of air. The material of the dielectric insert 113*f* has a dielectric constant that is greater than the dielectric constant of air. By selecting the size and shape of the dielectric insert 113*f*, including the structural features 646, the impedance of the plug connector 100*f* may be tuned, such as to achieve an impedance of 50 Ohms or another target impedance. For example, a design having more plastic in the isolation area between the outer contact 114 and the center contact 110 (e.g., a thicker tube, wider structural features 646, more structural features 646, longer structural features 646, and the like) may decrease the impedance, whereas providing more air may increase the impedance. Because of the non-cylindrical shape of the barrel 134, such as due to the paddles 135, the shape of the bore 640, defined by the structural features 646 and air pockets 648, is irregular. The air pockets 648 around the paddles 135 provide extra air around the paddles 135 and raise the impedance of the signal path in the area along the paddles 135.

Figure 11:
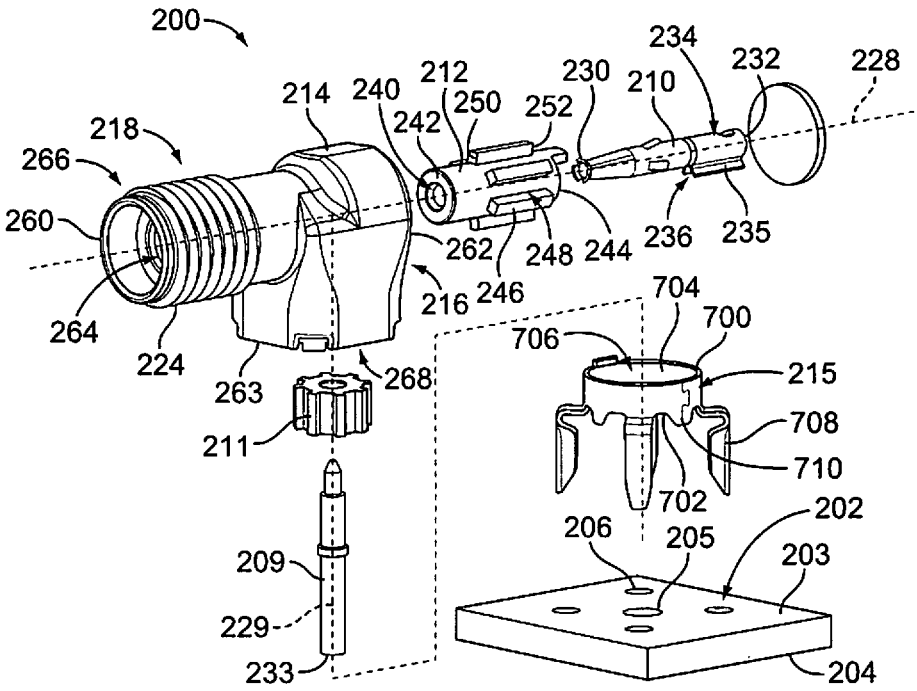
FIG. 11 is a front exploded view of a jack connector of the coaxial connector system in accordance with an exemplary embodiment.
Figure 12:
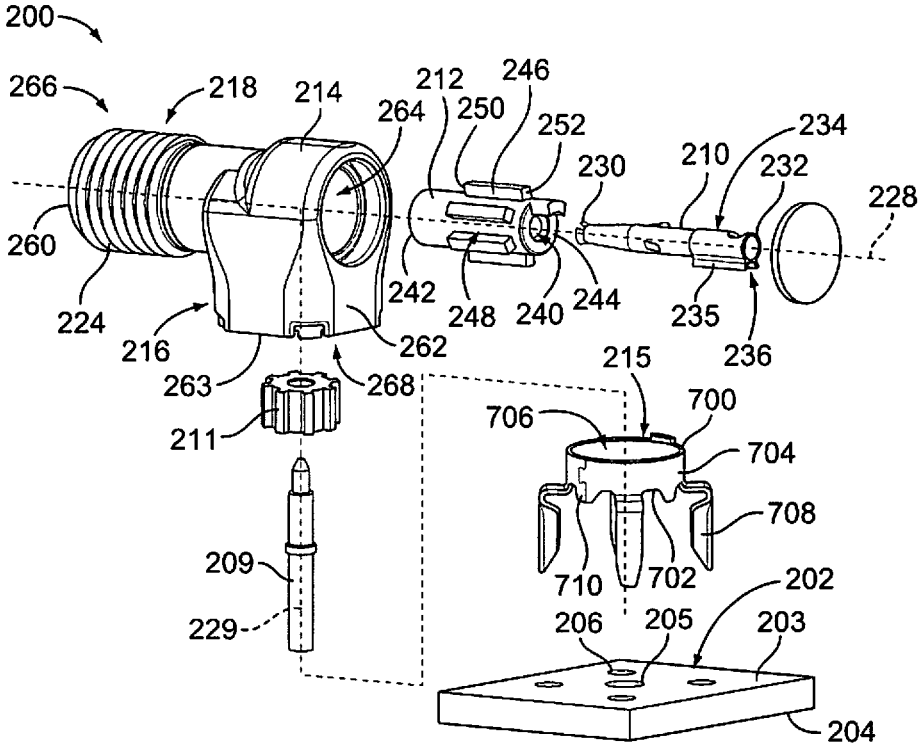
FIG. 12 is a rear exploded views of the jack connector in accordance with an exemplary embodiment.

FIGS. 11 and 12 are front and rear exploded views of the jack connector 200. The jack connector 200 is configured to be mounted to the printed circuit board (PCB) 202. The jack connector 200 is configured to be electrically coupled with the plug connector 100 (shown in FIG. 1).

The PCB 202 includes first and second surfaces 203, 204. A signal via 205 extends through the PCB 202 between the first and second surfaces 203, 204. The signal via 205 may be plated and electrically connected to a signal trace of the PCB 202 to define a signal conductor of the PCB 202. The signal via 205 is configured to be electrically connected to a board contact 209 of the jack connector 200.

The PCB 202 includes ground vias 206 extending through the PCB 202 between the first and second surfaces 203, 204. The ground vias 206 surround the signal via 205. The ground vias 206 may be plated and electrically connected to one or more ground planes of the PCB 202 to define ground conductors of the PCB 202. The ground vias 206 are configured to be electrically connected to a circuit board mount 215 of the jack connector 200.

In an exemplary embodiment, the board contact 209 and circuit board mount 215 are through-hole mounted to the PCB 202 by plugging the board contact 209 and circuit board mount 215 into the signal via 205 and ground vias 206, respectively. The jack connector 200 may be terminated to the PCB 202 by alternative means, such as by surface mounting the board contact 209 and/or circuit board mount 215 to the PCB 202. For example, rather than the signal via 205 and ground vias 206, the circuit board 202 may include ground pads with the board contact 209 and the circuit board mount 215 being surface mounted to the pads, such as by soldering to the pads.

The jack connector 200 includes the board contact 209 and a center contact 210 configured to be coupled together to define a signal path through the jack connector 200. The jack connector 200 includes a bottom dielectric insert 211 and a front dielectric insert 212 (optionally a rear dielectric insert (not shown), similar to the rear dielectric insert 113 (shown in FIG. 10) may be used, such as when the jack connector 200 includes a two-part outer contact) that are used to hold the board contact 209 and/or the center contact 210, respectively. The jack connector 200 includes an outer contact 214 that receives the dielectric inserts 211, 212 and the contacts 209, 210. The jack connector 200 includes the circuit board mount 215, which is coupled to the outer contact 214. The circuit board mount 215 and the outer contact 214 are electrically connected together and define a ground path or shield around the signal path. The circuit board mount 215 is used to mount the jack connector 200 to the PCB 202.

In an exemplary embodiment, the dielectric insert 212 may be identical to the dielectric insert 112 (shown in FIGS. 2 and 3). As such, the product family (both plug and jack connectors 100, 200) does not need to include different types of dielectric inserts for the plug and jack connectors 100, 200, thereby reducing the overall number parts for the product family and reducing the overall cost of the platform.

The board contact 209 is configured to be terminated to the PCB 202, such as to a signal conductor of the PCB 202. The board contact 209 is mechanically and electrically connected to the center contact 210 within the outer contact 214. The center contact 210 is configured to be electrically connected to a center contact of a plug connector, such as the center contact 110 of the plug connector 100 (both shown in FIGS. 2 and 3). The outer contact 214 is configured to be electrically connected to the PCB 202, via the circuit board mount 215, to a ground conductor of the PCB 202.

In an exemplary embodiment, the outer contact 214 is a single-piece body having a rear housing portion 216 and a front housing portion 218 integrally formed together. In alternative embodiments, the outer contact 214 may be a multi-piece body with the pieces coupled together. In the illustrated embodiment, the outer contact 214 defines a jack housing and may be referred to hereinafter as the jack housing 218. The jack housing 218 has external threads 224 for securing the jack connector 200 to the plug connector 100. The rear housing portion 216 receives the bottom dielectric insert 211 to support the board contact 209.

The center contact 210 extends along a contact axis 228 of the jack connector 200 between a separable interface at a mating end 230 and a non-separable terminating end 232. The contact axis 228 may be generally perpendicular to a contact axis 233 of the board contact 209. The mating end 230 is configured to be mated with the mating end 130 (shown in FIG. 2) of the center contact 110 (shown in FIG. 2) of the plug connector 100 when the jack connector 200 is coupled thereto.

The terminating end 232 is configured to be terminated to the board contact 209. In an exemplary embodiment, the center contact 210 has an open-sided barrel 234 at the terminating end 232. Optionally, the barrel 234 may be similar or identical to the barrel 134 (shown in FIGS. 2 and 3). The barrel 234 is configured to receive the board contact 209 to electrically connect the board contact 209 to the center contact 210. In the illustrated embodiment, the board contact 209 defines a pin contact, however the board contact 209 may have other configurations in alternative embodiments. The board contact 209 includes a terminating end 233 that is received in the plated signal via 205 of the PCB 202 to electrically connect the board contact 209 to the PCB 202. The terminating end 233 may be a compliant section held in the PCB 202 by an interference fit. Optionally, the terminating end 233 may be soldered to the PCB 202.

In an exemplary embodiment, the barrel 234 includes a pair of paddles 235 opposing one another and separated by a gap 236. The board contact 209 is received in the gap 236 between the paddles 235. The paddles 235 press against the board contact 209 to create an electrical connection therewith.

The dielectric insert 211 defines a bottom dielectric insert that is loaded into the bottom of the outer contact 214. The dielectric insert 211 holds the board contact 209. The dielectric insert 212 defines a front dielectric insert that is loaded into the outer contact 214. The dielectric insert 212 holds the center contact 210. The dielectric inserts 211, 212 are similar to one another. The dielectric insert 212 will be described in detail, but the dielectric insert 211 may include similar features and components.

The dielectric insert 212 has a bore 240 extending therethrough that receives and holds the center contact 210. The dielectric insert 212 extends between a front 242 and a rear 244. The bore 240 extends entirely through the dielectric insert 212 between the front 242 and the rear 244. The bore 240 extends axially along the contact axis 228 of the jack connector 200.

The dielectric insert 212 is generally tubular in shape and includes a plurality of structural features 246 extending radially outward from an exterior of the tubular dielectric insert 212 (the structural features of the dielectric insert 212 may be differently sized or shaped). Air gaps 248 are defined between the structural features 246. The structural features 246 are used to secure the dielectric insert 212 within the outer contact 214 by an interference fit therein. In an exemplary embodiment, the structural features 246 are tapered from a front 250 to a rear 252 of the structural features 246. In an exemplary embodiment, the size and shape of the structural features 246 are selected to provide a desired dielectric constant of the dielectric between the center contact 210 and the outer contact 214.

The outer contact 214 extends between a front 260 and a rear 262. The outer contact 214 has a bottom 263. The bottom 263 is configured to be mounted to the PCB 202. The bottom 263 is oriented generally perpendicular with respect to the front 260 and the rear 262. The circuit board mount 215 is coupled to the bottom 263. The outer contact 214 has a cavity 264 extending between the front 260 and the rear 262. The cavity 264 extends to the bottom 263. The cavity 264 turns 90° within the outer contact 214 to create a path between the front 260 and the bottom 263. The cavity 264 receives the dielectric insert 212 and center contact 210. The cavity 264 receives the dielectric insert 211 and the board contact 209. In an exemplary embodiment, the front 260 of the outer contact 214 defines a separable interface end 266 of the outer contact 214. The bottom 263 of the outer contact 214 defines a terminating end 268 of the outer contact 214. The terminating end 268 is oriented generally perpendicular with respect to the separable interface end 266. The jack connector 200 defines a right angle or 90° connector. The signal path through the jack connector 200 is changed along the right angle path.

The circuit board mount 215 is configured to mechanically and electrically connect the outer contact 214 to the PCB 202. The circuit board mount 215 includes a top 700 and a bottom 702. A cylindrical rim 704 surrounds a cavity 706 extending between the top 700 and the bottom 702. Mounting legs 708 extend from the bottom 702 of the rim 704. The mounting legs 708 are terminated to the PCB 202 to secure the circuit board mount 215 to the PCB 202. The mounting legs 708 may be received in the plated ground vias 206 in the PCB 202 to mechanically and electrically connect the circuit board mount 215 to the PCB 202. The mounting legs 708 may be press fit into the vias in the PCB 202 to mechanically and/or electrically connect the circuit board mount 215 to the PCB 202. The rim 704 includes tabs 710 at the bottom 702. The tabs 710 are used to secure the circuit board mount 215 in the outer contact 214.

Figure 13:
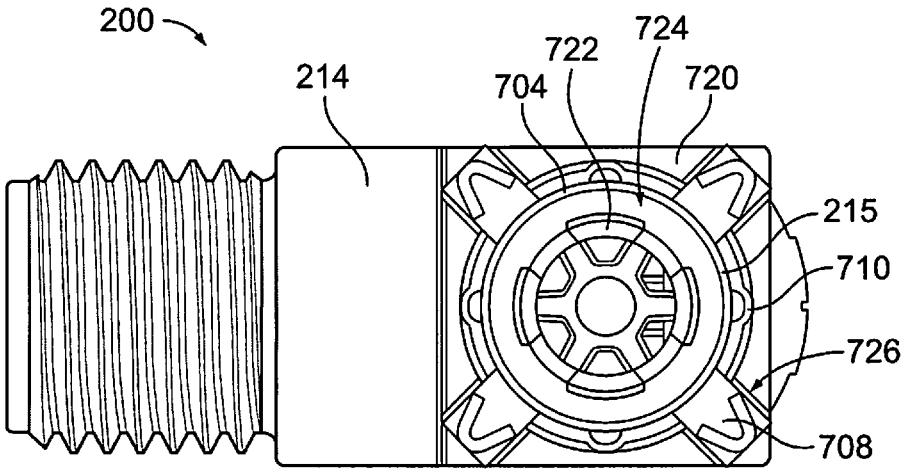
FIG. 13 is a bottom view of the jack connector in accordance with an exemplary embodiment.

FIG. 13 is a bottom view of the jack connector 200 showing the circuit board mount 215 coupled to the outer contact 214. In an exemplary embodiment, the outer contact 214 includes a shroud 720 surrounding a barrel 722, with a groove 724 defined between the shroud 720 and the barrel 722. The rim 704 is loaded into the groove 724. The tabs 710 are pressed against the shroud 720 to hold the circuit board mount 215 therein by an interference fit.

In an exemplary embodiment, channels 726 are provided at the bottom of the outer contact 214 that extend between the groove 724 and the exterior of the shroud 720. In the illustrated embodiment, the channels 726 are provided at the corners of the shroud 720, however the channels 726 may be provided at other positions in alternative embodiments. The mounting legs 708 extend into corresponding channels 726. The mounting legs 708 are secured in the channels 726. In an exemplary embedment, the shroud 720, at the edges of the channels 726, may be staked to the mounting legs 708 to secure the mounting legs 708 in the channels 726. Other means or processes may be used to mechanically and electrically couple the circuit board mount 215 to the outer contact 214.

Figure 14:
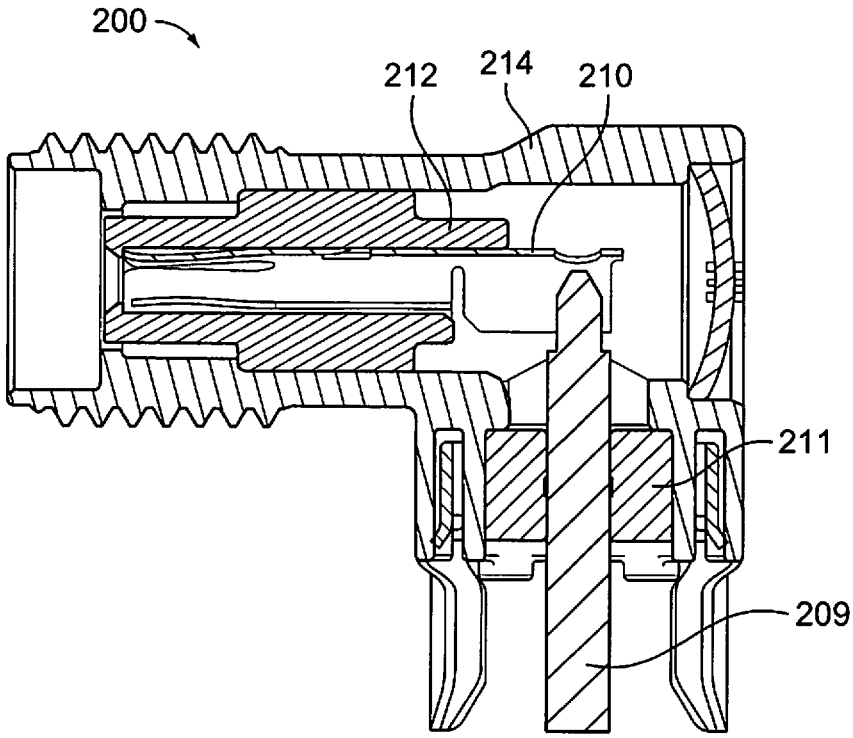
FIG. 14 is a cross-sectional view of the jack connector in accordance with an exemplary embodiment.

FIG. 14 is a cross-sectional view of the jack connector 200 showing the center contact 210 loaded in the dielectric insert 212 and outer contact 214. The board contact 209 is loaded in the dielectric insert 211 and engages the center contact 210.

Figure 15:
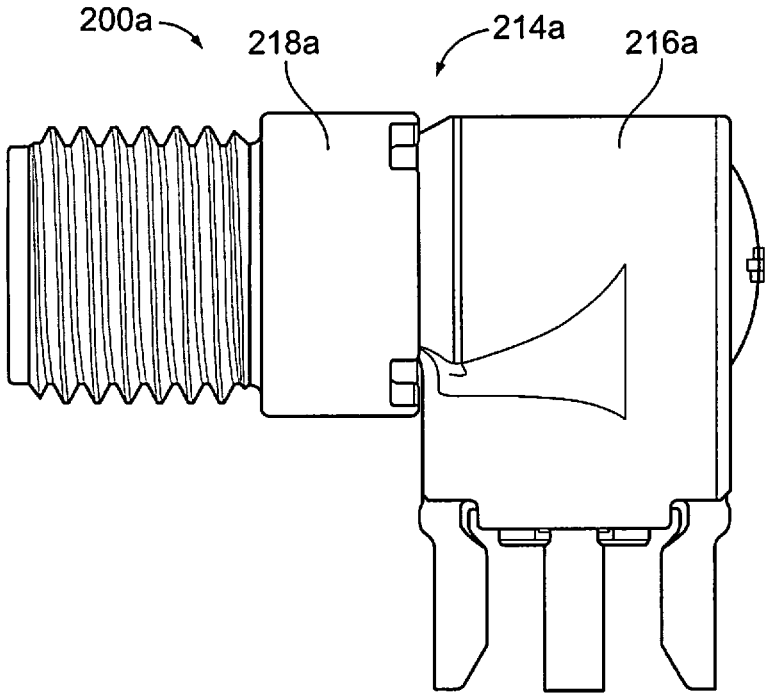
FIG. 15 is a side view of a jack connector in accordance with an exemplary embodiment.

FIG. 15 is a side view of an alternative jack connector **200*a*. The jack connector 200*a* is similar to the jack connector 200 (shown in FIGS. 11 and 12), and like components are identified with like reference numerals. The jack connector 200*a* includes an outer contact 214*a*. The outer contact 214*a* may be similar to the outer contact 214, however the outer contact 214*a* is a multi-piece body. The outer contact 214*a* includes a front housing 218*a* and a rear housing 216*a***.

Figure 16:
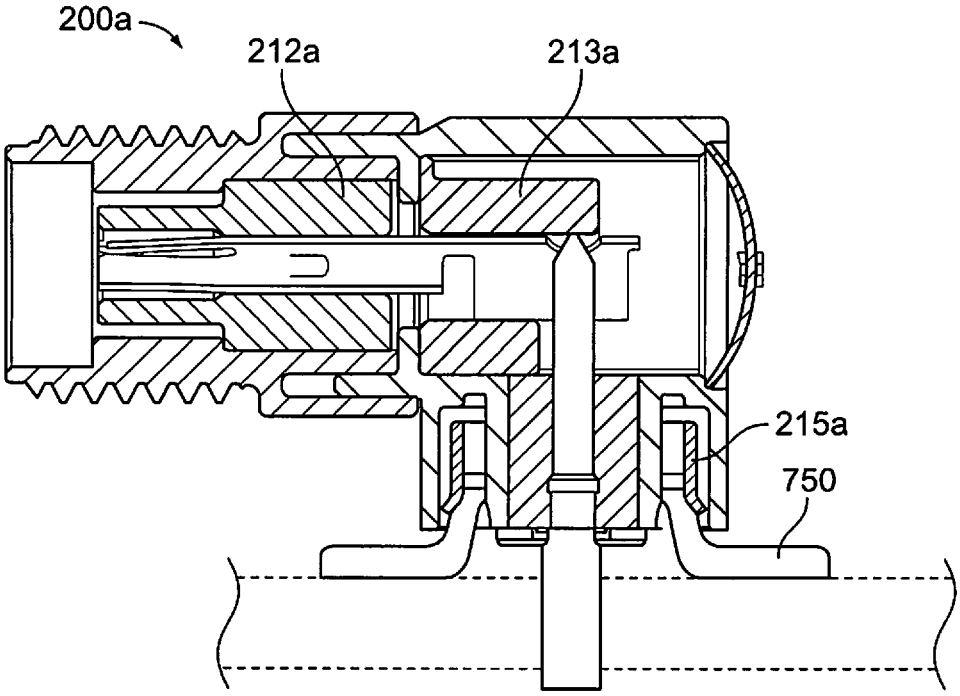
FIG. 16 is a cross sectional view of a jack connector in accordance with an exemplary embodiment.

FIG. 16 is a cross sectional view of the jack connector **200*a* having an alternative circuit board mount 215*a*. The circuit board mount 215*a* includes surface mount legs 750, rather than the compliant, through-hole mounting legs 708 of the circuit board mount 215 (shown in FIGS. 11 and 12**).

The jack connector **200*a* includes a front dielectric insert 212*a* and a rear dielectric insert 213*a*. The front dielectric insert 212*a* may be substantially similar to the front dielectric insert 212 (shown in FIGS. 11 and 12). The rear dielectric insert 213*a* may be substantially similar to the rear dielectric insert 113*f* (shown in FIG. 10**).

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A coaxial connector comprising:

a center contact configured to be mated with a center contact of a mating coaxial connector;

a board contact coupled to the center contact, the board contact configured to be terminated to a circuit board;

an outer contact having a cavity, the center contact and board contact being disposed in the cavity and being electrically connected to one another in the cavity, the outer contact having a separable interface end configured to be mated to the mating coaxial connector, the outer contact having a terminating end configured to be mounted to the circuit board;

a circuit board mount coupled to the terminating end, the circuit board mount being configured to electrically connect the outer contact to the circuit board; and a dielectric insert received in the cavity, the dielectric insert having a bore extending axially along the dielectric insert that receives and holds either the center contact or the board contact, the dielectric insert having structural features extending axially along an exterior of the dielectric insert and spaced radially apart to define radial spaces between the axially extending structural features, air gaps being defined in the radial spaces between the structural features, the structural features engaging the outer contact to secure the dielectric insert in the cavity.

2. The coaxial connector of claim 1, wherein the separable interface end and terminating end are oriented perpendicular to one another, and wherein the center contact and the board contact extend along corresponding contact axes oriented perpendicular to one another.

3. The coaxial connector of claim 1, wherein the center contact has a mating end and a terminating end, the center contact having an open-sided barrel at the terminating end with two paddles opposing one another across a gap, the board contact being received in the gap and the paddles pressing against the board contact to make an electrical connection between the board contact and the center contact.

4. The coaxial connector of claim 1, wherein the size and shape of the structural features are selected to provide a desired dielectric constant of dielectric between the center contact and the outer contact to tune the impedance of the coaxial connector.

5. The coaxial connector of claim 1, wherein the dielectric insert engages the outer contact and the structural features hold the dielectric insert by an interference fit in the cavity.

6. The coaxial connector of claim 1, wherein the circuit board mount includes mounting legs configured to be terminated to the circuit board to mechanically and electrically connect the circuit board mount to the circuit board.

7. The coaxial connector of claim 1, wherein the outer contact includes a barrel at the terminating end, the outer contact having a shroud surrounding the barrel at the terminating end, the outer contact having a circumferential groove disposed between the barrel and the shroud, the circuit board mount having a cylindrical rim and mounting legs extending from the rim, the rim being received in the circumferential groove, the mounting legs being configured to be terminated to the circuit board to mechanically and electrically connect the circuit board mount to the circuit board.

8. The coaxial connector of claim 1, wherein the outer contact includes a front housing and a rear housing coupled to the front housing, the front housing receiving the dielectric insert to support the center contact, the coaxial connector further comprising a second dielectric insert received in the rear housing to support the board contact.

9. The coaxial connector of claim 1, wherein the circuit board mount comprises a cylindrical rim and a plurality of mounting legs extending from the rim, the rim being coupled to the terminating end of the outer contact, the mounting legs being configured to be terminated to the circuit board to mechanically and electrically connect the circuit board mount to the circuit board.

10. The coaxial connector of claim 1, wherein the outer contact is a unitary one piece body between the separable interface end configured to contact the mating connector and the terminating end configured to be mounted to the circuit board.

11. A coaxial connector comprising:

a center contact configured to be mated with a center contact of a mating coaxial connector;

a board contact coupled to the center contact, the board contact configured to be terminated to a circuit board;

a dielectric insert having a bore that receives and holds at least one of the center contact and the board contact;

an outer contact having a cavity, the center contact and board contact being disposed in the cavity and being electrically connected to one another in the cavity, the outer contact having a separable interface end configured to be mated to the mating coaxial connector, the outer contact having a terminating end, the outer contact including a barrel at the terminating end and a shroud surrounding the barrel with a groove disposed between the barrel and the shroud;

wherein the outer contact is interchangeably coupled to either a first circuit board mount or a second circuit board mount at the terminating end, the first and second circuit board mounts both including a cylindrical rim and mounting legs extending from the rim, the rims being selectively received in the groove, the mounting legs of the first circuit board mount configured to be through hole mounted to the circuit board, the mounting legs of the second circuit board mount configured to be surface mounted to the circuit board.

12. The coaxial connector of claim 11, wherein the separable interface end and terminating end are oriented perpendicular to one another, and wherein the center contact and the board contact extend along corresponding contact axes oriented perpendicular to one another.

13. The coaxial connector of claim 11, wherein the board contact is either through hole mounted or surface mounted to the circuit board.

14. The coaxial connector of claim 11, wherein the center contact has a mating end and a terminating end, the center contact having an open-sided barrel at the terminating end with two paddles opposing one another across a gap, the board contact being received in the gap and the paddles pressing against the board contact to make an electrical connection between the board contact and the center contact.

15. The coaxial connector of claim 11, wherein the dielectric insert has structural features extending axially along an exterior of the dielectric insert, air gaps being defined between the structural features, the structural features engaging the outer contact to secure the dielectric insert in the cavity.

16. The coaxial connector of claim 15, wherein the size and shape of the structural features are selected to provide a desired dielectric constant of dielectric between the center contact and the outer contact to tune the impedance of the coaxial connector.

17. A coaxial connector comprising:

a center contact configured to be mated with a center contact of a mating coaxial connector, the center contact having a mating end and a terminating end, the center contact having an open-sided barrel at the terminating end with two paddles opposing one another across a gap;

a board contact configured to be terminated to a circuit board, the board contact being received in the gap between the paddles with the paddles pressing against the board contact to make an electrical connection between the board contact and the center contact;

an outer contact having a cavity, the center contact and board contact being disposed in the cavity and being electrically connected to one another in the cavity, the outer contact having a separable interface end configured to be mated to the mating coaxial connector, the outer contact having a terminating end configured to be mounted to the circuit board; and a dielectric insert received in the cavity, the dielectric insert having a bore that receives and holds either the center contact or the board contact, the dielectric insert having structural features extending axially along an exterior of the dielectric insert, air gaps being defined between the structural features, the structural features engaging the outer contact to secure the dielectric insert in the cavity.

18. The coaxial connector of claim 17, wherein the separable interface end and terminating end are oriented perpendicular to one another, and wherein the center contact and the board contact extend along corresponding contact axes oriented perpendicular to one another.

19. The coaxial connector of claim 17, further comprising a circuit board mount coupled to the terminating end, the circuit board mount includes mounting legs configured to be terminated to the circuit board to mechanically and electrically connect the circuit board mount to the circuit board.

20. The coaxial connector of claim 17, wherein the size and shape of the structural features are selected to provide a desired dielectric constant of dielectric between the center contact and the outer contact to tune the impedance of the coaxial connector.

* * * * *